United States Patent [19]

Johansson

[11] Patent Number: 5,036,981

[45] Date of Patent: Aug. 6, 1991

[54] WRAP-AROUND BOX FOR CONTAINERS

[75] Inventor: Björn Johansson, Rönninge, Sweden

[73] Assignee: Akerlund & Rausing Licens Aktiebolag, Jarfalla, Sweden

[21] Appl. No.: 464,953

[22] Filed: Jan. 16, 1990

[30] Foreign Application Priority Data

Feb. 2, 1989 [SE] Sweden ..... 8900153

[51] Int. Cl.[5] ..... B65D 5/54

[52] U.S. Cl. ..... 206/611; 206/608

[58] Field of Search ..... 206/605, 608, 611, 626, 206/628

[56] References Cited

U.S. PATENT DOCUMENTS

| | | | |
|---|---|---|---|
| 2,074,451 | 3/1937 | Berberian | 206/602 |
| 2,330,720 | 9/1943 | Laflamme | 206/608 |
| 3,018,942 | 1/1962 | Arneson | 206/628 |
| 3,109,577 | 11/1963 | Knipp | 206/626 |
| 3,454,212 | 7/1969 | Elward | 206/626 |
| 3,863,834 | 2/1975 | Sandford | 206/611 |
| 4,083,454 | 4/1978 | O'Neill | 206/611 |
| 4,524,901 | 6/1985 | Tikka | 206/611 |

*Primary Examiner*—Gary E. Elkins

[57] ABSTRACT

A wrap-around box for a unit of small containers has a bottom part and a top part integrally connected by a common rear panel. The bottom part includes a bottom panel, a front panel connected to the bottom panel, and a pair of opposing end panels connected to the bottom panel and to the front and rear panels. The top part includes a lid panel connected to the upper edge of the common rear panel along a fold line, a front panel, and a pair of opposing end panels. The front and end panels of the top part are disposed inwardly of and in face-to-face relation to the associated front and end panels of the bottom part when the box is in closed condition. Forwardly facing edges of the front panels on the top part are disposed in pressing engagement with the inner surface of the front panel of the bottom part when the box is in its closed condition and maintain the box in the latter condition. A tear-away panel defined by a tear-line coincident with the fold line and another tear-line defined by the top panel is provided for opening the box. When the tear-away panel is removed the top part is freely separable in an upward direction from the bottom part. The bottom part supports the containers when the top part has been removed.

13 Claims, 3 Drawing Sheets

WRAP-AROUND BOX FOR CONTAINERS

The present invention relates to a wrap-around box for containers. Nowadays such wrap-around boxes are frequently used as wrappings for storing, transporting and exhibiting containers of different types. The wrappings generally are formed as a closed box containing several small packages or containers and arranged to be opened by cutting or tearing the tope and a certain part of the sides of the box are torn or cut open, the bottom and another part of the sides being maintained as a carrier for the small containers. After the wrap-around box has been opened and the top part removed the entire unit of containers is exhibited for sale in the remaining bottom part of the box which supports the containers.

Such a wrap-around box must, fulfill several demands; it must be relatively easy to slit open; closed to eliminate loss of containers by making it impossible to pick out small containers before it is slit open; strong and stable so that it can be handled easily even after it has been opened and so that several units can be piled on top of each other; it should be formed so as to make it possible to relatively easily pick out small containers after it has been opened, and, at the time, it should support and protect the small containers. Such a box should have an attractive appearance; be simply and cheaply manufactured; be simple and easy to close and be formed so that the customer does not cut or otherwise injure himself when he picks the containers out of the box.

Most know so called wrap-around boxes fail in fulfilling one or more of the above mentioned demands. Some known wrap-around boxes must be cut open, whereby there is risk of personal injury or damage to the packed small containers. Other wrap-around boxes are formed with tear-open-tape which may be difficult to use. Still other wrap-around boxes are relatively easily opened, so that small containers can be picked out without leaving any exterior sign that the box has been unduly opened. Other boxes are formed so that reclosing requires a time consuming joining operation, which may include providing several glue joints or applying several stitches. Other boxes are formed with tear open lines, in particular at the sides facing the customer, which tear open lines, after the box has been opened, exhibit a saw tooth like edge which may cut the customer or tear his clothing.

The object of the invention therefore is to provide a new type of wrap-around box, which box is formed so that it can be only two joints, preferably glue joints; which box exposes an outwardly or towards the customer a smooth, even and attractive edge; and which box can be opened very simply and with very little effort.

The invention is mainly characterized in that the wrap-around box is formed as two integral units which can easily be separated when the box is opened, and which box comprises a bottom part and a top part or opening part. The bottom part is formed with a bottom sheet or panel and surrounding sides which are joined to each other, and in which the opening part comprises a lid sheet or panel and on at least three sides thereof side sheets, which are integral with the lid sheet. The three side sheets are introduced inside the sides of the bottom part and are freely engaging said bottom sides. The opening part is integral with the bottom part only along one side edge, along which there is a tear open means.

At least the two opposite sides of the opening part have edges "facing the store or the customer" and engage, with a predetermined fit, the inner side of the front panel or outwardly facing "long side" of the bottom part, so that it is substantially impossible to fold up the opening part to open position about the edge thereof over which the opening part is integrally connected with the bottom part, in spite of the fact that the sides of the top part or opening part are free from the bottom part.

Further characteristics and advantages of the invention will be apparent from the following detailed description in which reference will be made to the accompanying drawings.

In the drawings

Figure 1:
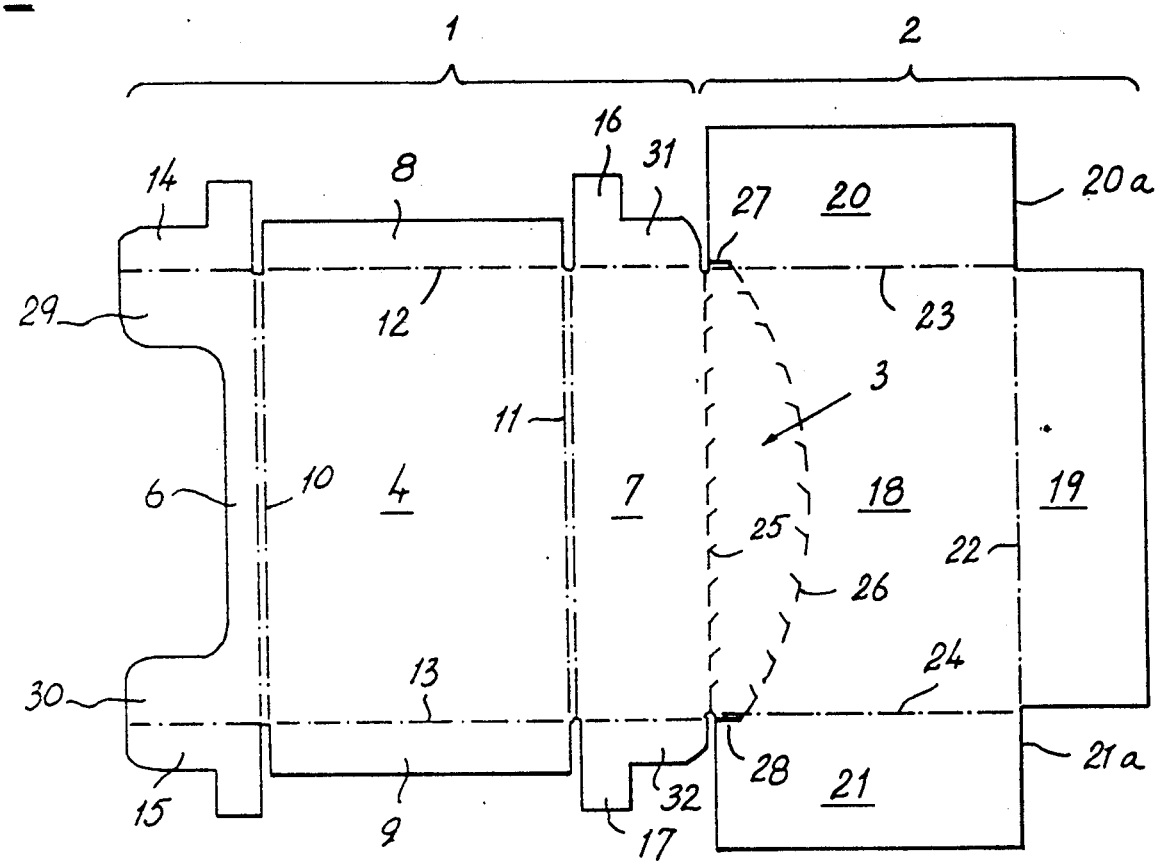
FIG. 1 shows a blank for a wrap-around box according to the invention.

The wrap-around box is made from integral plane blank, which is illustrated in FIG. 1, and which is punched from a material having a suitable strength and stability, for instance from corrugated cardboard. The blank generally comprises a bottom part 1 and a top part 2 which are integrally connected by some type of a tear-open means or a tear-open flap 3. The box generally has a parallellepipedical shape, but it may, of course, be formed with any kind of polygonal bottom shape.

The bottom part 1 comprises a bottom sheet or panel 4 on which several small containers 5 are adapted to be placed, a front side or panel 6, a rear side or panel 7 and two opposite side sheets or panels 8 and 9. As usual the four sides 6–9 are divided from the bottom sheet 4 by score lines 10–13. The front side 6 is formed with two opposite glue flaps 14 and 15 projecting from the side edges of the front side. Also the rear side 7 similarly has two glue flaps 16 and 17 respectively. All of the glue flaps 14–17 are arranged to be folded in and joined with the side sheets 8 and 9, preferably by a glue joint on each side of the box.

The top part 2 comprises a lid sheet or panel 18 which is integrally connected with the rear side 7 of the bottom part by the tear-open means 3, and the three free sides thereof provide a front side 19 and two opposite side sheets or end panels 20 and 21, which sheets are, as usual, divided from the lid sheet 18 by score lines 22, 23 and 24. An important feature of the invention resides in the edges **20*a* and 21*a* of the sides 20 and 21 facing outwardly or forwardly at the same angle as the front side panel 6 of the bottom part, and extending for some distance out in front of the score line 22, which distance corresponds to the sum of the score line size and half the thickness of the cardboard or corrugated cardboard material, whereby the outer edges 20*a* and 21*a* bluntly engage the inner surface of the bottom part front side 6. There is consequently no play that could make it possible to press the sides 20 and 21 upwards thereby opening the lid without removing the tear-open means 3. It is also possible to form the corners at the edges 20*a* and 21*a* facing forwardly and downwardly projecting ears such as indicated at 21b in FIG. 5 which ears presses against the front side 6** adjacent the front-bottom corner of the bottom part.

The tear-open means 3 shown in the drawings comprises two tear-off lines 25 and 26. The tear-off line 25 extends along a line of division or fold line between the lid 18 and the rear side 7 of the bottom part, and the tear-off line 26 extends arcuately between two cut through opening lines 27 and 28 from which release of the top part 2 from the bottom part 1 is intended to start. In combination with the straight tear-off line 25 the bow-formed or arcuate tear-off line 26 provides a correctly designed tear-open means for ideal tear-open movement. Said tear-open means allows a simple, quick and easy opening of the box. At the same time the condition of the tear-open means directly indicates if the tear-open means has been unduly manipulated. The tear open means can be formed with many different designs, for instance by two parallel tear-off lines, by one single tear-off line 25 and behind said tear-off line a tear-open strip, or in any other know ways. The only essential point is that the tear-open means be provided at the rear side of the box, that is at the side of the box which is opposite to the side facing the customer.

Figure 5:
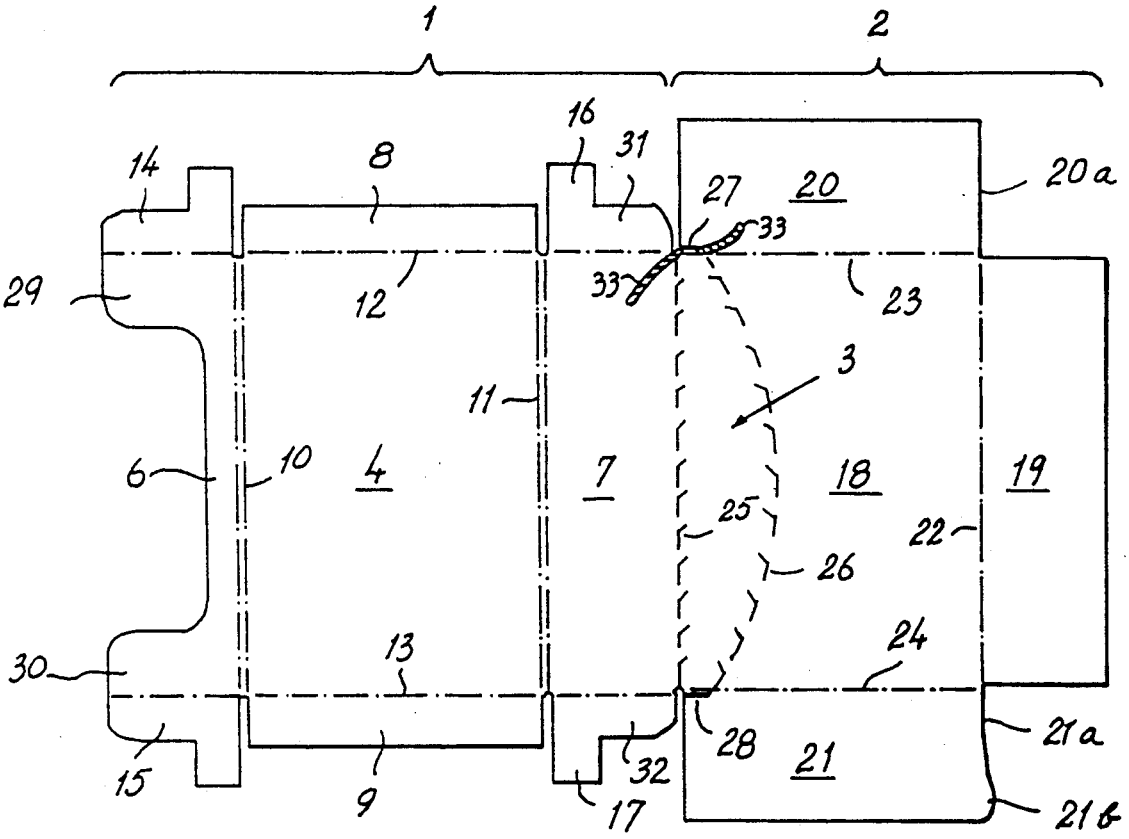
FIG. 5 shows another wrap-around box embodying the invention.

In FIG. 5 there is shown another embodiment of the invention which includes a tear-off string which underlies the tear-off lines 25 and 26, the exposed opposite ends of the string being indicated at 33.

The sides 6, 8 and 9 of the bottom part 1 and the glue flaps 14, 15, 16, 17 and the rear side 7 preferably are formed both to provide a support for the small containers 5 even after the top part 2 has been removed, and to allow an easy picking out of containers, one by one, both from the in front and from the side of the box. For this purpose the front side 6 of the bottom part adjacent the corners of the box and the glue flaps 14–17 of the front and rear sides are formed with portions 29, 30, 31, and 32 respectively, having a full height, whereas an intermediate part of the front side and parts of the glue flaps have a height which is only about half or less of the height of the box. Similarly the bottom side sheets 8 and 9 have a height which is substantially less than the height of the box, and preferably the same height as the low portions of the glue flaps. Since all edges of the front of the bottom part facing outwardly toward the store and the customer are punched from the box blank said edges are smooth and even and there is no risk that the customer will cut or tear his clothing on the edges. The only edge which can provide sharp or tearing projections is the edge of tear-off line 25 and this edge is located at the far back of the box and is not reached when picking small containers out of the wrap-around box.

Figure 2:
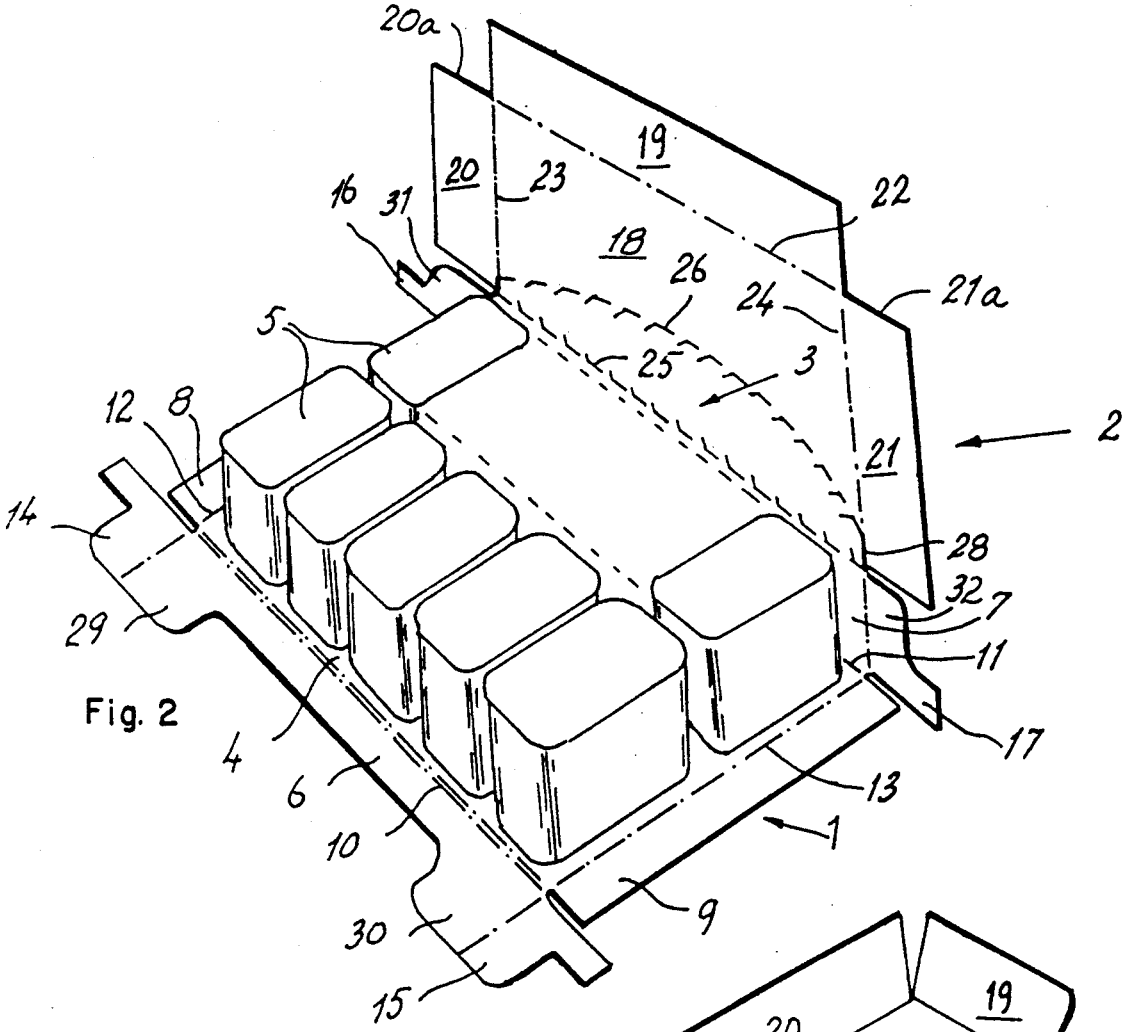
FIG. 2 shows the box blank of FIG. 1, partly erected, with small containers on the bottom of the box blank.

FIG. 2 diagrammatically illustrates the method of closing the box. Several small containers 5 are put on the bottom sheet 4; the rear side 7 with the top part 2 is folded up; the sides 19, 20 and 21 of the top part 2 are folded down from the lid 18, and the lid with the turned down sides is folded down over the small containers 5, so that the sides 19, 20 and 21 of the top part engage the small containers 5; the front side 6 of the bottom part 1 is then folded up; the glue flaps 14, 15 and the glue flaps 16, 17 are folded in; and finally glue or a double sided sticking tape is applied to the side sheets 8 and 9 of the bottom part 1, and said side sheets are adhered to the glue flaps 14–17. Alternatively the glue flaps 14–17 and the side sheets 8, 9 can be joined in another way, for instance by being welded together by means of weldable layers of material, by means of stitches, rivets or other mechanical means.

Figure 3:
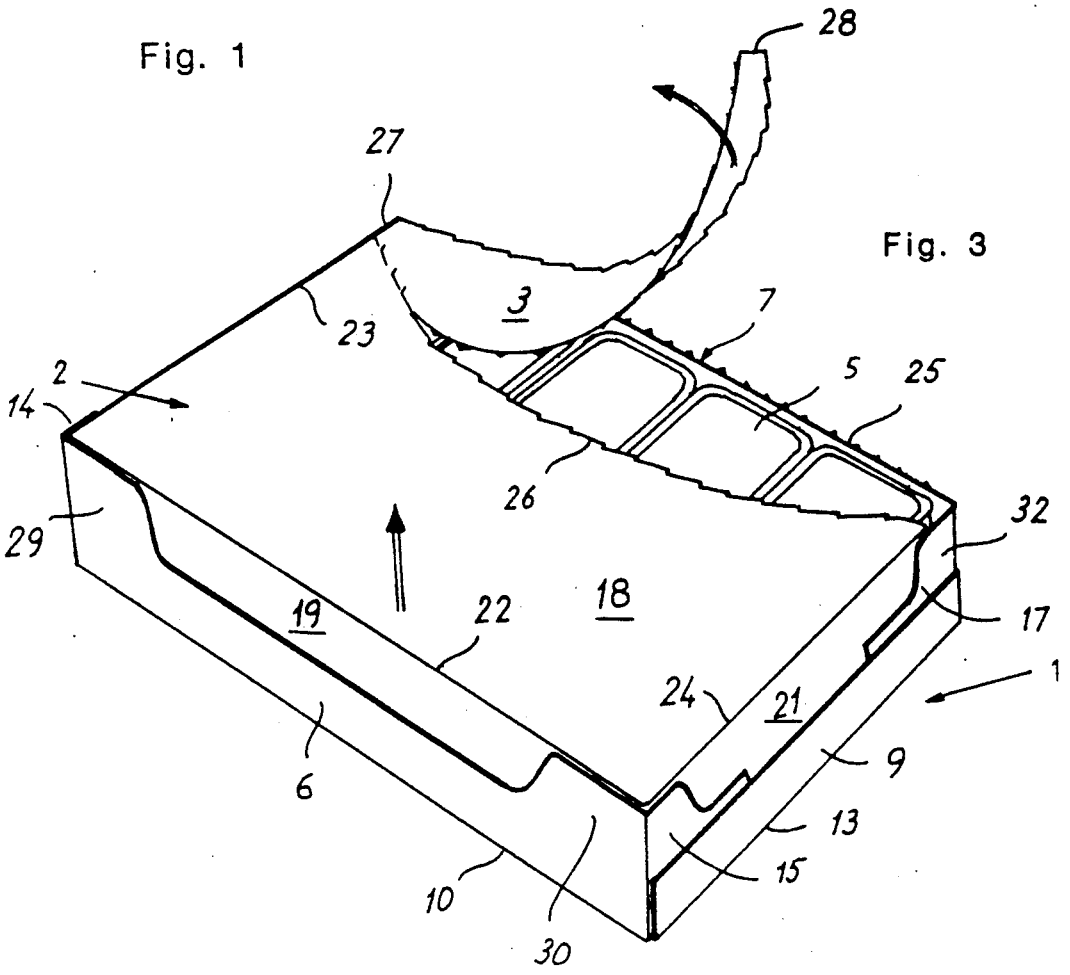
FIG. 3 shows a closed wrap-around box according to the invention in the initial stage of being opened.
Figure 4:
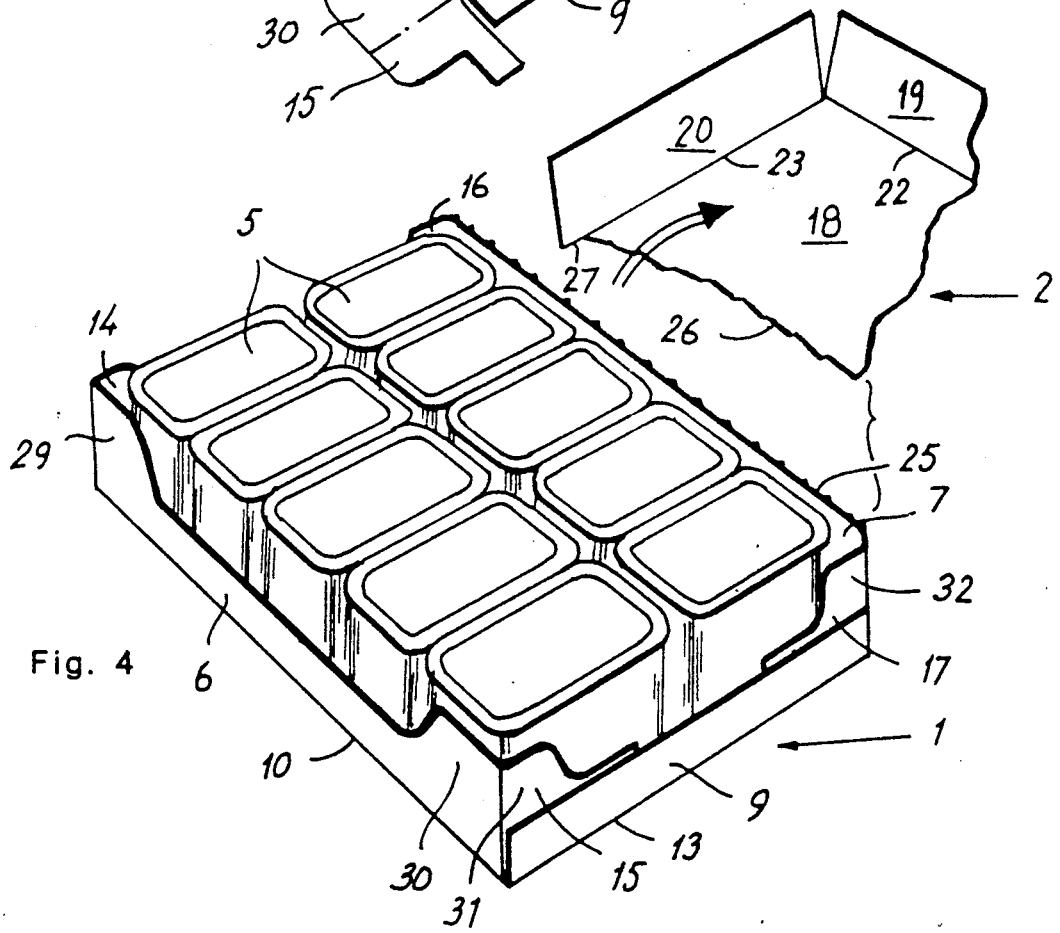
FIG. 4 shows a box according to the invention in its fully opened state and with the top part of the box completely removed.

FIGS. 3 and 4 diagrammatically show the method of opening the wrap-around box according to the invention. This is done by pulling the tear-open flap 3 straight upwards starting at either of the slit open ends 27, 28 thereof, whereby the tear-open flap is released along the tear-off lines 25 and 26. When the tear-open flap 3 is released from the container the entire top part 2 is released from the bottom part and can easily be moved straight up as indicated by the arrows of FIG. 3. Thereby the container becomes quite opened as shown in FIG. 4 and the small containers 5 can be picked out, one by one or even several containers at the same time. Of course the released top part can, if desired, be put back over the bottom part to protect the small containers.

I claim:

1. Wrap-around box for a unit of small containers and having a bottom part (1) including a polygonal bottom panel (4) and side panels (6, 8 and 9) connected to the bottom panel (4), a top part (2) including a lid panel (18) and side panels (19, 20 and 21) connected to the lid panel (18), and a common side panel (7) connected to said bottom panel (4) and to said lid panel (18) and integrally connecting said top part (1) to said bottom part (2) when the box is in closed condition, the top part (2) being separable from the bottom part (1) and said common side panel (7) when the box is in open condition, and tear-open means for opening the wrap-around box, characterized in that said side panels (19, 20 and 21) of said top part (2) are disposed inwardly of and in face-to-face relation to associated portions of said side panels (6, 8 and 9) of said bottom part (2), said side panels of said top part (2) being freely separable from said side panels of said bottom part (1) and said common side panel (7) when said box is opened by said tear-open means, said bottom panel, said side panels of said bottom part (1) and said common side panel (7) providing support for the unit of the small containers when the wrap-around box is in open condition.

2. Wrap-around box according to claim 1 further characterized by means for maintaining said box in said closed condition including edges of two side panels (20 and 21) of said top part (2) cooperating in pressing engagement with the inner surface of an associated side panel (6) of said bottom part (1).

3. Wrap-around box according to claim 2 further characterized in that said means for maintaining said box in closed condition further includes glue flaps (14, 15, 16 and 17) connecting said side panels comprising said bottom part (1).

4. Wrap-around box according to claim 3 characterized in that the height dimensions of said side panels (19, 20 and 21) of said top part (2) are substantially equal to the height of said box and the height dimensions of at least a portion of said side panels (6, 8 and 9) of said bottom part (1) are substantially less than the height dimension of said box.

5. Wrap-around box according to claim 4 characterized in that said lid panel (18) is connected to said common side panel (7) along a fold line (25) and said tear-open means comprises a tear-off line coincident with said fold line (25).

6. Wrap-around box according to claim 5 characterized in that said tear-open means further includes another tear-off line (26) defined by said lid panel (18) and extending between the ends of said tear-off line (25).

7. Wrap-around box according to claim 6 characterized in that said tear-off line (26) comprises a generally arcuate tear-off line.

8. Wrap-around box according to claim 7 wherein said tear-off means includes a tear-off string underlying said tear-off line (25) and said tear-off line (26).

9. Wrap-around box according to claim 5 wherein said tear-off means includes a tear-off string underlying said tear-off line (25).

10. Wrap-around box according to claim 1 characterized in that said common panel (7) comprises a rear panel, said side panels include opposite end panels (8 and 9) and (20 and 21) and front panels (6 and 19) and wherein said opposite end panels (20 and 21) of said top part (2) have forwardly facing front edges (20*a* and 21*a*) engageable with the inner surface of said front panel (6) of said bottom part (1) for preventing said top part (2) from being folded to an open condition relative to said bottom part (1).

11. Wrap-around box according to claim 10 wherein at least one of said end panels (20*a* and 21*a*) of said top part (2) has a forwardly projecting ear (21*b*) thereon for pressing engagement with the inner surface of said front panel (6) of said bottom part.

12. Wrap-around box according to claim 11 wherein said front panel (6) of said bottom part (1) and said rear panel (7) have glue flaps (14, 15, 16 and 17) connected to the front and rear edges thereof disposed inwardly of said end panels 8 and 9 of said bottom part (1).

13. Wrap-around box according to claim 12 characterized by glue flaps (14, 15, 16 and 17) connected to the front and rear edges of said front panel (6) of said bottom part (1) and said rear panel (7) and each of said glue flaps (14, 15, 16 and 17) is disposed inwardly of an associated one of said end panels (8 and 9) of said bottom part (1).

* * * * *